United States Patent [19]

Hauer

[11] Patent Number: 4,998,474

[45] Date of Patent: Mar. 12, 1991

[54] FLUSH INKING UNIT

[75] Inventor: Horst-Walter Hauer, Wurzburg, Fed. Rep. of Germany

[73] Assignee: Koenig & Bauer Aktiengesellschaft, Wurzburg, Fed. Rep. of Germany

[21] Appl. No.: 499,724

[22] Filed: Mar. 27, 1990

[30] Foreign Application Priority Data

Apr. 11, 1989 [DE] Fed. Rep. of Germany ..... 3911836

[51] Int. Cl.[5] ..... B41F 31/08

[52] U.S. Cl. ..... 101/366; 101/350; 101/331; 101/340; 118/259; 118/261; 118/407; 118/413

[58] Field of Search ..... 101/350, 366, 331, 340; 118/259, 261, 407, 413

[56] References Cited

U.S. PATENT DOCUMENTS 2,018,193 10/1935 Smith ..... 101/366
3,641,932 2/1972 Behringer ..... 101/366
4,559,871 12/1985 Kutzner et al. .
4,945,855 8/1990 Eklund et al. ..... 118/407

FOREIGN PATENT DOCUMENTS 360365 4/1962 Switzerland ..... 118/407

*Primary Examiner*—Edgar S. Burr
*Assistant Examiner*—Eric P. Raciti
*Attorney, Agent, or Firm*—Jones, Tullar & Cooper

[57] ABSTRACT

A flush inking unit for a screened surface ink fountain roller utilizes an inking groove spaced from and located within a housing to supply ink to the ink fountain roller. Ink dividing plates of the ink groove are spaced from the surface of the ink fountain roller. Printing ink which is supplied to the inking groove and which passes out of the groove through the spaces between the ink dividing plates and the roller is collected in the housing and returned to an ink supply reservoir.

5 Claims, 2 Drawing Sheets

FLUSH INKING UNIT

FIELD OF THE INVENTION

The present invention is directed generally to a flush inking unit. More particularly, the present invention is directed to a flush inking unit for use with an ink fountain roller of a web-fed rotary printing press. Most specifically, the present invention is directed to a flushing inking unit which does not contact the ink fountain roller. A pressurized ink applying space is surrounded by a reduced pressure ink recovering space in the inking unit. A plurality of fluid inking units in accordance with the present invention may be positioned along the length of the ink fountain roller. Since there is no contact between the flush inking unit and the ink fountain roller, higher rotational speeds of the ink fountain roller with less wear are possible.

DESCRIPTION OF THE PRIOR ART

The use of flush inking units in conjunction with ink fountain rollers in web-fed rotary printing machines is generally known in the art. These flush inking units are used to provide the ink that is applied to the screened surface of the ink fountain roller. One such flush inking unit for a fast running screened surface ink fountain roller may be seen in German published, unexamined patent application No. 3,320,638, which corresponds to U.S. Pat. No. 4,559,871. This flush inking unit is provided with a plurality of spaced ink dividing plates that are each biased toward the surface of the screened ink fountain roller by suitable springs. Thus the ink fountain divider plates are continually biased into contact with the screened surface of the ink fountain roller by the spring forces exerted by them.

Contact of these spring biased ink fountain dividing plates with the rapidly rotating surface of the screened ink fountain roller inevitably results in the production of circumferential grooves or furrows on the surface of the ink fountain roller. Furthermore, this contact also results in wear to the ink dividing plates. Initially, as the ink fountain dividing plates wear down, they can be automatically adjusted by providing sufficiently strong springs to keep moving the ink dividing plates into contact with the screened surface of the ink formation roller or by providing other similar automatic adjustment means. Eventually however, the ink dividing plates wear out and must be replaced.

Even more detrimental to the operation of the assembly is the creation of furrows or grooves on the surface of the ink fountain roller. These furrows reduce the quality of the ink distribution across the face of the ink fountain roller. This loss of quality is particularly evident when the format to be printed is changed from, for example a ¼ width impression to a ½ width impression, as would be the case when the machine was being changed from a single page impression to a double page impression.

The rotational speed of the ink fountain roller is limited by the contact of the ink dividing plates with the screen surface of the ink fountain roller. The amount of wear of both the ink dividing plates and the surface of the ink fountain roller is a function of the rotational speed of the ink fountain roller. This wear increases enormously as the circumferential speed of the ink fountain roller increases.

It will thus be apparent that there is a need for a flush inking unit having ink dividing plates that do not wear and that do not harm the ink fountain roller. The flush inking unit of the present invention provides such a device and is a substantial improvement over the prior art devices.

SUMMARY OF THE INVENTION

It is an object of the present invention to provide a flush inking unit.

Another object of the present invention is to provide a flush inking unit for use with a high speed ink fountain roller.

A further object of the present invention is to provide a flush inking unit having ink dividing plates that do not contact the surface of the ink fountain roller.

Yet another object of the present invention is to provide a flush inking unit having a pressurized ink space.

Still a further object of the present invention is to provide a flush inking unit having a pressurized inking space surrounded by a reduced pressure space.

Even another object of the present invention is to provide a flush inking unit having uniform ink pressure along the length of the pressurized inking space.

As will be discussed in greater detail in the description of the preferred embodiment which is set forth subsequently, the flush inking unit in accordance with the present invention preferably utilizes a plurality of individual flush inking units that are placed adjacent each other along the length of a high speed screened surface ink fountain roller. Each flush inking unit has a housing which includes side plates or covers and doctor blades that are carried by the front and rear walls of each unit. These side plates or covers are shaped to cooperate with, but not contact, the periphery of the high speed ink fountain roller and are spaced at a small distance from the surface of the ink fountain roller. An inking groove is carried within each ink housing and also has ink dividing plates that are shaped to cooperate with, but not contact the ink fountain roller's periphery. Ink under a positive pressure is fed into the inking groove and contacts the surface of the ink fountain roller. Any ink which passes out of the ink space in the inking groove between the ink dividing plates and the peripheral surface of the ink fountain roller is retained in the space in the housing. This space may be maintained at a lesser pressure and any ink entering this space can be returned to a suitable supply container.

Since the ink dividing plates and the housing side plates or covers of the flush inking unit of the present invention do not contact the surface of the screened surface ink fountain roller, there is no wear on the ink fountain roller. The elimination of the grooves previously worn into the ink fountain roller by the ink dividers of the prior art flush inking units results in an improvement of printing quality. Switching from ¼ width printing to ½ width printing can be accomplished with no reduction in quality.

High speed printing operations are facilitated by the flush inking unit of the present invention. Since there is not contact between the ink dividing plates and the ink fountain roller, there are no frictional forces to build up heat. This allows the ink fountain roller to operate at quite high rotational speeds. The flush inking unit of the present invention also allows for the elimination of additional doctor blades. It is equally well suited for use with both water and oil based printing inks. Further, the direction of rotation of the ink fountain roller may be reversed.

The flush inking unit in accordance with the present invention allows the ink fountain roller to operate at higher speeds with less wear and with better print quality than was possible with prior devices. It will thus be apparent that this device is a significant advance in the art.

BRIEF DESCRIPTION OF THE DRAWINGS

While the novel features of the flush inking unit in accordance with the present invention are set forth with particularity in the appended claims, a full and complete understanding of the invention may be had by referring to the detailed description of the preferred embodiment which is presented subsequently, and as illustrated in the accompanying drawings, in which;

DESCRIPTION OF THE PREFERRED EMBODIMENT

Figure 1:
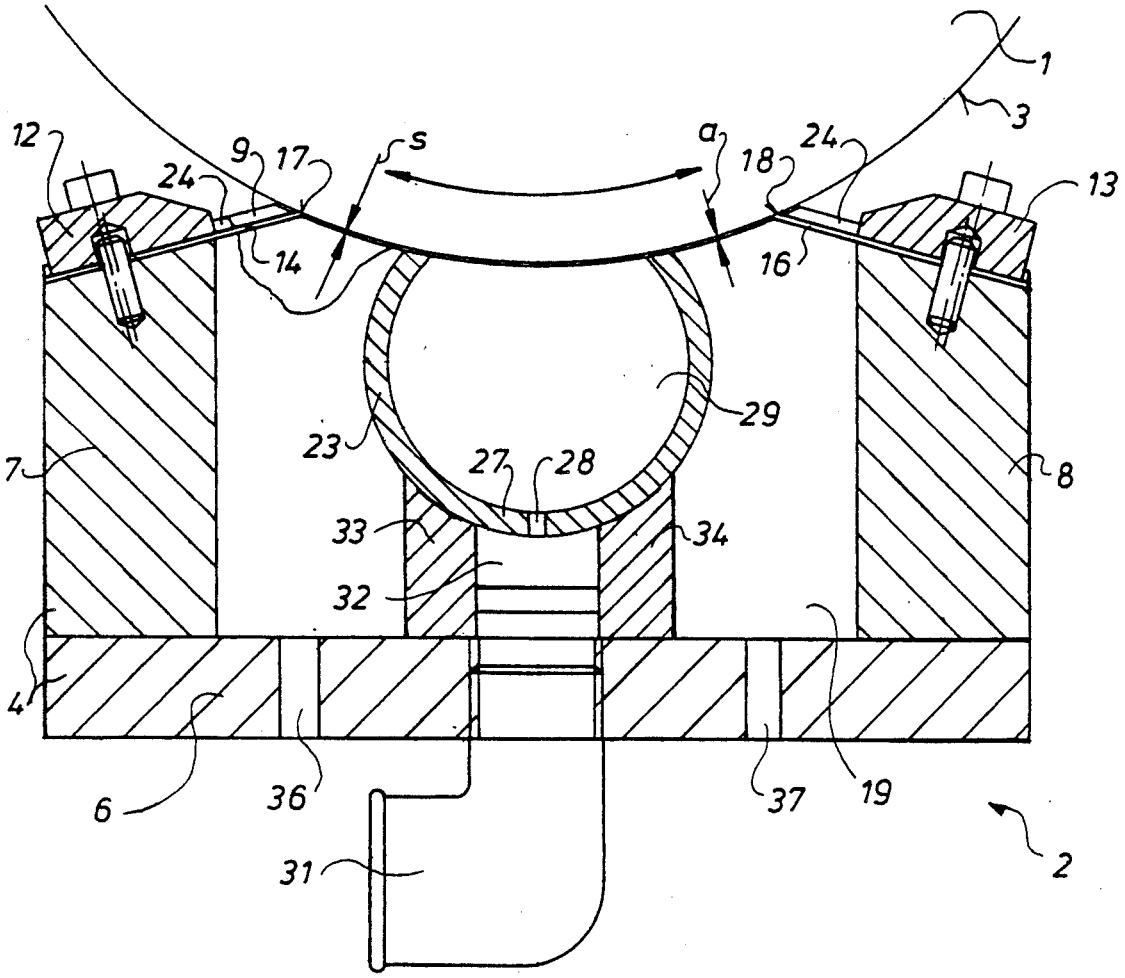
FIG. 1 is a schematic cross-sectional side elevation view of the flush inking unit of the present invention.

Referring initially to FIG. 1 there may be seen a flush inking unit, generally at 2, in accordance with the present invention. A generally well known ink fountain roller 1 receives ink from the flush inking unit 2 and transfers the ink to a web fed rotary printing assembly (not shown) in a generally well known manner. As may be seen in FIG. 2, a plurality of similar flush inking units 2 may be disposed adjacent each other along the length of the ink fountain roller 1. There may, for example, be four such flush inking units 2 with each unit covering about ¼ of the width to be printed. In accordance with the present invention, each ink fountain unit 2 may be raised or elevated into cooperation with a peripheral surface 3 of the ink fountain roller 1, preferably from beneath the ink fountain roller 1, without bringing ink dividing plates of each of the flush inking units 2 into contact with the peripheral surface 3 of the ink fountain roller 1.

Each flush inking unit 2 has a housing 4 which includes a base plate 6; a front wall 7, and a back wall 8; and a left lateral cover or side plate 9 and a right lateral cover or side plate 11. On the front and the back walls 7 and 8 doctor blades 14 and 16 are clamped by means of suitable clamping pieces 12 and 13. Each of these doctor blades 14 and 16 has a front doctor blade edge 17 and 18, respectively, which cooperate with the peripheral surface 3 of the ink fountain roller 1 in a generally well known manner. The screened ink roller 1 forms, together with the housing of the flush inking unit, a closed ink space 19 which has a small gap "s" of approx. 0.2 to 0.5 mm between the covers 9 and 11 respectively and the peripheral surface 3 of the ink fountain roller 1. This closed ink space 19 and the small gap "s" between the lateral left and right covers or side plates 9 and 11 and the ink fountain roller periphery 3 may be best seen by referring to FIG. 2.

Figure 2:
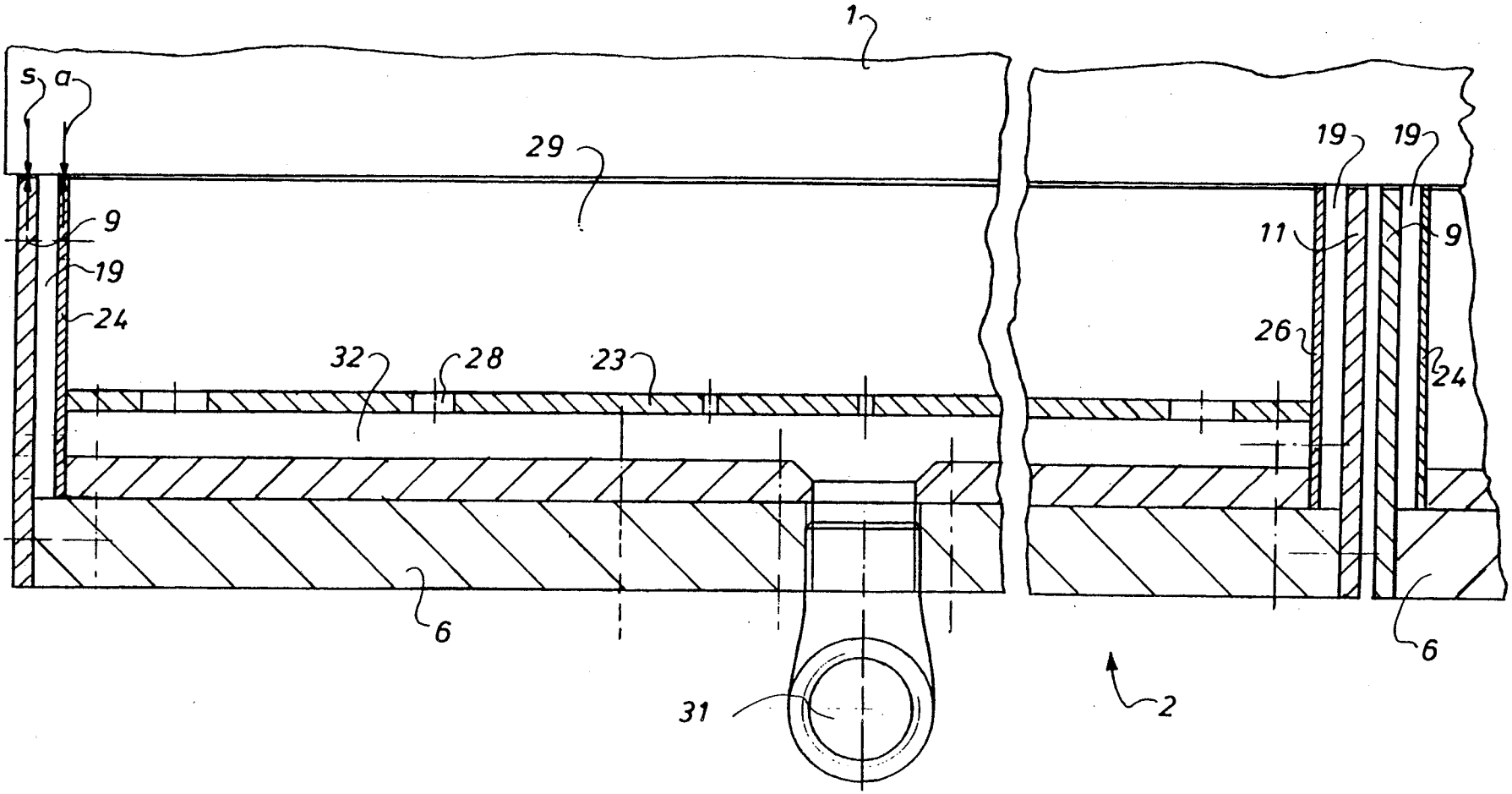
FIG. 2 is schematic cross-sectional longitudinal view of the flush inking unit.

An inking groove, generally at 23, which extends generally axially along the length of the housing 4 of each of the flush inking units 2, may be seen most clearly in FIG. 2. In accordance with the present invention, this inking groove 23 is comprising of a section of a tubular conduit, such as a pipe with a portion of the periphery thereof removed to provide an upwardly facing opening. As may be seen in FIG. 1, this upper opening of the inking groove 23 faces the peripheral surface 3 of the screened ink fountain roller 1. Left and right ink dividing plates 24 and 26, respectively, are provided at the ends of the inking groove 23. These left and right ink dividing plates, 24 and 26, are shaped to correspond to, and to cooperate with, the peripheral surface 3 of the ink fountain roller and are spaced therefrom by a small gap "a" which is generally about 0.2 mm. The inking groove 23 cooperates with the periphery 3 of the ink fountain roller 1 and the two ink dividing plates 24 and 26 to define an ink space 29 which is essentially closed except for the small gaps "a" between the ink dividing plates 24 and 26 of the inking groove 23 and the ink fountain roller.

An ink feeding channel 32 is provided beneath the ink groove 23 and above the base plate 6 of the housing 4. The ink feeding channel 32 is defined by the base plate 6, a bottom portion 27 of the inking groove 23 and spaced ink feeding channel side walls 33 and 34. The ink feeding channel 32 extends along beneath the entire length of the inking groove 23 in each of the flush inking units 2, as may be seen most clearly in FIG. 2.

A plurality of ink feeding boreholes 28 are formed in the bottom 27 of the inking groove 28. These ink feeding boreholes 28 allow ink to pass from the ink feeding channel 32 into the inking groove 23. As may be seen most clearly in FIG. 2, these ink feeding boreholes 28 are spaced generally equally along the axial length of the bottom 27 of the inking groove 23. However, the cross-sectional areas of these ink feeding boreholes 28 increase as the distance of each borehole 28 from a generally centrally located ink feeding conduit 31 increases. As may also be seen in FIG. 2, this ink feeding conduit 31 is joined to the ink feeding channel 32 generally midway between the two ink dividing plates 24 and 26 at the ends of each flush inking unit. By varying the cross-sectional areas of the ink feeding boreholes 28, as shown in FIG. 2, the pressure of the ink in the inking groove 23 is maintained generally uniform throughout the entire inking groove 23.

Printing ink is pumped, or otherwise delivered through ink feeding connection 31, to the ink feeding channel 32 at a slight pressure of generally about 0.5 to 1 bar. This printing ink passes through the spaced ink feeding boreholes 28 and into the ink space 29 in the inking groove 23. The screened surface ink fountain roller 11 is caused to rotate by any suitable means (not shown) and takes up ink from the ink space 29. The small space or gap "a" between the periphery 3 of the ink fountain roller 1 and the ink dividing plates 24 and 26 of the inking groove will allow a small amount of the printing ink to pass cut into the spaces 19 between the ink dividing plates 24 and 26 and the left and right side covers 9 and 11, respectively. Since the ink in the ink space 29 is under a slight positive pressure, the amount of ink flowing into the spaces 19 will be a function of the viscosity of the ink. Once this ink reaches spaces !9, it can flow out ink outlet boreholes 36 and 37 which are formed in base plate 6. This ink may be returned to a suitable ink reservoir. A suitable exhausting device (not shown) can be connected to the ink outlet boreholes 36 and 37. This can intensify the sealing process since space 19 is thereby provided with a slightly reduced pressure.

In the preferred embodiment of the flush inking unit in accordance with the present invention, the inking groove 23 is depicted as a simple cylinder. It is within the scope of the invention that other shapes could be used for this inking groove 23. It would, for example be possible to provide doctor blades on the inking groove's axially extending edges generally in a manner similar to the doctor blades carried on the outer walls of the flush inking unit 2. Various profiled bodies, which enhance the circulation of the ink in the inking groove 23, could also be positioned in the inking space 29. It is also possible to position ink suction boreholes and connecting lines (not specifically shown) at an upper portion of the inking groove. Any foam or ink enriched with air bubbles due to the high speed rotation of the ink fountain roller in the ink space 29 could be drawn off out of the ink space by such a suction assembly.

The preferred embodiment of the flush inking unit 2, in accordance with the present invention is provided with two side covers or plates 9 and 11, and with two ink dividing plates 24 and 26 for each flush inking unit 2. It would be possible to provide additional laterally spaced side covers so that three or more such side covers are provided on each unit.

While a preferred embodiment of a flush inking unit for a web-fed rotary printing machine in accordance with the present invention has been set forth fully and completely hereinabove, it will be apparent to one of skill in the art that a number of changes in, for example, the type of ink fountain roller, the type of printing ink used, the number of inking units positioned along the ink fountain roller, the materials used, and the like may be made without departing from the true spirit and scope of the present invention which is accordingly to be limited only by the following claims.

What is claimed is:

1. A flush inking unit useable to supply printing ink to a peripheral surface of an ink fountain roller of a web fed rotary printing machine, said flush inking unit comprising:

an inking unit housing having a base plate, spaced front and rear walls and spaced first and second side covers, said first and second side covers each having an upper surface which is shaped to cooperate with, and to conform with, a peripheral surface of an ink fountain roller and which is spaced from a peripheral surface of an ink fountain roller to define a small gap between said upper surfaces of said first and second side covers of said inking unit housing and a peripheral surface of an ink fountain roller, said inking unit housing defining a closed ink space;

an inking groove positioned in said closed ink space defined by said inking unit housing, said inking groove having first and second ink dividing plates, said first and second ink dividing plates being spaced from, and generally parallel to said first and second side covers, said first and second ink dividing plates each having an upper surface which is shaped to cooperate with, and to conform with a peripheral surface of an ink fountain roller and which is spaced from a peripheral surface of an ink fountain roller to define a small gap between said upper surfaces of said first and second ink dividing plates and a peripheral surface of an ink fountain roller, said inking groove defining an ink space, said ink space being positioned within said closed ink space; and means for supplying printing ink to said inking groove and for maintaining said printing ink in said inking groove at a first pressure which is higher than a second pressure maintained in said closed ink space.

2. The flush inking unit of claim 1 wherein said means for supplying printing ink to said inking grove is a plurality of ink feeding boreholes which are distributed along said inking groove and further wherein a cross-sectional ink flow area of each of said ink feeding boreholes is larger with increased distance between each of said ink feeding boreholes and an ink feeding connection.

3. A flush inking unit for use in supplying printing ink to a peripheral surface of an ink fountain roller in a web-fed rotary printing machine; said flush inking unit comprising:

an inking unit housing having a base plate, spaced front and rear walls, and spaced first and second side covers, each of said first and second side covers having an upper surface which is shaped cooperatively with a peripheral surface of an ink fountain roller and which is spaced therefrom by a small gap, said inking unit housing defining a closed ink space;

an ink feeding channel in said inking unit housing and having spaced side walls which are generally parallel to said front and rear walls of said inking unit housing;

an inking groove positioned atop said ink feeding channel and having an ink space which receives ink from said ink feeding channel, said inking groove having first and second spaced ink dividing plates, said first and second spaced ink dividing plates being spaced from and generally parallel to said first and second side covers, each of said first and second ink dividing plates having an upper surface which is shaped cooperatively with a peripheral surface of an ink fountain roller and which is spaced therefrom by a small gap, said ink space being positioned within said closed ink space; and means for supplying printing ink to said inking groove through said ink feeding channel and for maintaining said printing ink in said ink space at a first pressure which is higher than a second pressure maintained in said closed ink space.

4. The flush inking unit of claim 3 wherein an ink feeding connection is in fluid communication with said ink feeding channel and supplies printing ink to said ink feeding channel.

5. The flush inking unit of claim 4 wherein said inking groove has a plurality of spaced ink feeding boreholes that allow ink to flow from said ink feeding channel to said ink space, a cross-sectional ink flow area of each of said ink feeding boreholes being proportional to a distance of each said ink feeding borehole from said ink feeding connection.

* * * * *